United States Patent · [19]

Eiffinger

[11] 4,240,656

[45] Dec. 23, 1980

[54] APPARATUS FOR RETRIEVAL AND DISPOSAL OF ANIMAL EXCREMENTS

[76] Inventor: Karlheinz Eiffinger, Piccoloministr. 308, 5000 Köln 80, Fed. Rep. of Germany

[21] Appl. No.: 948,867

[22] Filed: Oct. 5, 1978

[51] Int. Cl.[3] ..... A01K 29/00; A47L 13/52

[52] U.S. Cl. ..... 294/1 BA; 15/257.1; 15/257.7; 294/1 B; 294/53.5

[58] Field of Search ..... 294/1 R, 1 B, 1 BA, 294/19 R, 50.6, 50.8, 51, 53.5, 55, 59; 15/104.8, 257.1, 257.4, 257.6, 257.7; 220/1 T; 232/43.1, 43.2, 47–49, 60; 312/302, 323

[56] References Cited

U.S. PATENT DOCUMENTS

| | | | |
|---|---|---|---|
| 1,135,519 | 4/1915 | Haldenwang | 15/257.4 |
| 3,456,663 | 7/1969 | Blum | 294/53.5 X |
| 3,539,095 | 11/1970 | James | 232/43.1 |
| 3,560,039 | 2/1971 | Gruber | 15/257.1 UX |
| 3,804,448 | 4/1974 | Schmieler | 294/1 BA X |
| 4,005,892 | 2/1977 | Williams | 294/55 X |
| 4,154,389 | 5/1979 | Dell'Anno | 15/257.1 X |

FOREIGN PATENT DOCUMENTS

| | | | |
|---|---|---|---|
| 1019249 | 11/1957 | Fed. Rep. of Germany | 294/59 |

*Primary Examiner*—Johnny D. Cherry

*Attorney, Agent, or Firm*—Spensley, Horn, Jubas & Lubitz

[57] ABSTRACT

Disclosed herein is an apparatus for the picking up and disposal of animal excrements in a hygienic and simple manner. The apparatus provides for one or more lined shovels to be attached to one end of a telescoping shaft. The shaft is provided with a handle, allowing its use as a walking stick. It is optionally provided with a wheel on the end. By placing the shovel end of the shaft on the ground, and depressing the other end of the shaft, the shaft telescopes, causing the shovels to be tilted from their normally upright position to a position in which they are horizontal with the ground and able to pick up the desired excrements. In order to select which of the shovels attached to the shaft is to be tilted to the ground, a pin and wing nut assembly is provided for each shovel. This assembly permits the coupling or decoupling of the individual shovel's tilting lever from the shaft.

18 Claims, 8 Drawing Figures

FIG.6
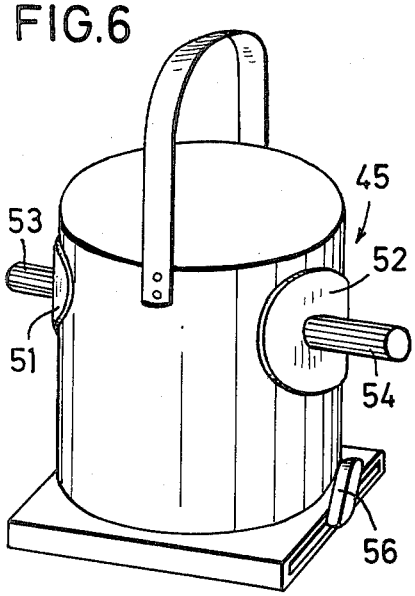
FIG.7
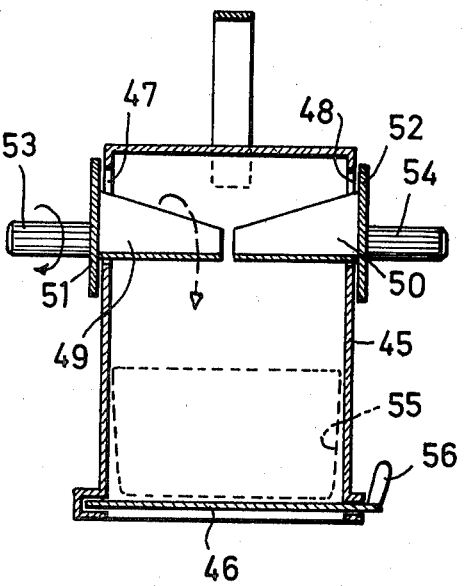
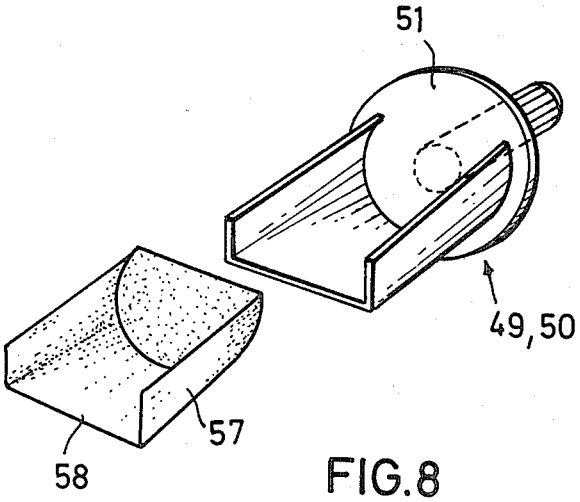
FIG.8

APPARATUS FOR RETRIEVAL AND DISPOSAL OF ANIMAL EXCREMENTS

BACKGROUND OF THE INVENTION

1. Field of the Invention

This invention relates to a device for receiving and disposal of animal excrements.

2. Description of the Prior Art

Contamination of streets, sidewalks, and even of playgrounds by animal excrements is a serious problem. The difficulty is that the animal's owner, taking his animal for a walk, is not able to remove the excrements dropped during the walk because the owner has no suitable device for this purpose.

Those owners concerned with the public sanitation and aesthetic beauty of the public areas of the city have had to avail themselves of implements not specifically designed for this problem. Such means as garden shovels and paper sacks have not provided the convenience and hygienic disposal which is desirable. Inasmuch as appropriately designed devices have not been commonly available, the typical animal owner will walk away from the problem.

It is the object of this invention to do away with the disadvantages of make-shift devices and methods not appropriately designed for the problem under discussion, and to provide devices for the convenient and hygienic retrieval and disposal of animal excrement.

Known prior art includes the U.S. Pat. No. 3,716,263 to Gatti and the West German Offenlegungsschrift 24 55 113 which show different types of excrement retrieval devices.

SUMMARY OF THE INVENTION

The invention disclosed herein provides an apparatus able to be comfortably carried along by the animal owner without discomfort or unpleasantness. The device allows for the receiving of excrements in an inoffensive manner and for the hygienic disposal of them. A shovel appropriately shaped for the picking up and transportation of excrements is provided. The shovel contains a removable, disposable liner which is appropriately reinforced to prevent its tearing due to scraping of the shovel along the ground or due to the moisture content of the excrements. The liner can be easily removed, together with the excrements within, allowing for hygenic disposal. The shovel liner prevents the animal excrements from contaminating the shovel. It may be of single or double layer design, permitting absorption without contamination of the shovel.

As an alternative embodiment, a container can also be provided. It also is protected by a liner. After picking up the excrements, they may be dumped into the container for transportation to the disposal site.

In a further embodiment of the invention, the shovel is attached by a pivot to one end of the shaft. The pivot allows for the rotation of the shovel from an upright position to a horizontal position appropriate for the receiving of excrements. In its upright position the shovel forms a container for transportation of the excrements. The animal's owner can take the shaft with him to use as a walking aid. The animal can perhaps be trained to relieve itself on the horizontal shovel. Alternatively, the shovel can be used to pick up excrements already on the ground. A wheel is provided at the lower end of the stick to permit this to be done conveniently. To permit the tilting of the shovel, the shaft is constructed to be telescoping in its longitudinal direction. When telescopically compressed against a stop on the shaft, a lever is moved, causing the shovel to tilt downward. Additionally, the shaft may be fitted with more than one shovel, each shovel having its tilting lever independently coupled to the shaft via a pin and wing nut assembly. By an appropriate adjustment of a shovel's wing nut, its pin is extended, causing its tilting lever to be coupled to the shaft, thereby selecting the shovel for lowering upon telescopic compression of the shaft.

BRIEF DESCRIPTION OF THE DRAWINGS

FIG. 6 is a perspective view of a second embodiment of the invention.

FIG. 7 is a longitudinal section through the device illustrated in FIG. 6.

FIG. 8 is a perspective view of a shovel employed in the device illustrated in FIGS. 6 and 7.

DETAILED DESCRIPTION OF THE PREFERRED EMBODIMENTS

The embodiment of FIGS. 1 through 5 consists of a shaft 10 with a handle 11 at its upper end and with the shovel apparatus 12, shown in detail in FIGS. 2 through 5, at its lower end.

Figure 4:
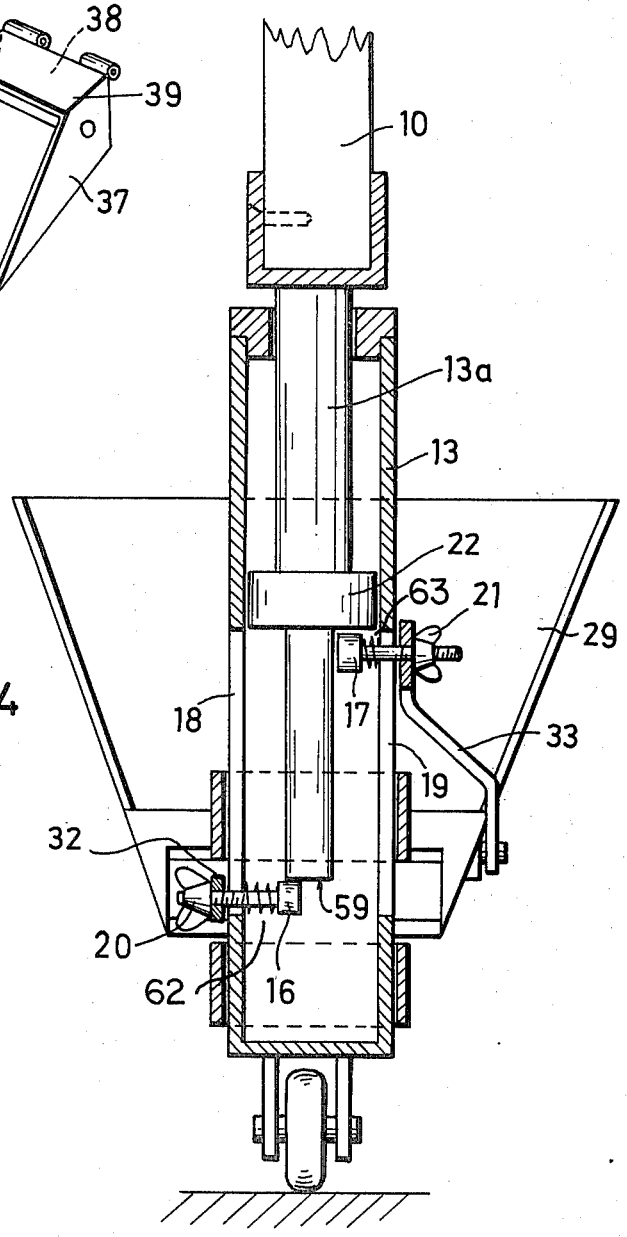
FIG. 4 is a longitudinal section in a vertical plane perpendicular to the sectional plane pictured in FIG. 2.

Telescopic rod 13*a* is projecting from, or a unitary longitudinal extension of the lower end of shaft 10. Telescopically sliding on telescopic rod 13*a* is telescopic tube 13, which is closed at its lower end. A collar 22 attached to telescopic rod 13*a* limits the telescopic extension of telescopic tube 13 while simultaneously maintaining coaxial alignment of the telescopic tube 13 with respect to the shaft 10. Below the collar 22, the telescopic rod 13*a* projects into the telescopic tube 13. A spring 14 is positioned between a spring retainer plate 15 and the bottom end of the telescopic tube 13. The spring retainer plate 15 is located below the end of the telescopic rod 13*a* and is able to longitudinally slide inside telescopic tube 13. The spring 14 resists the telescopic compression of the shaft 10, telescopic rod 13*a*, and telescopic tube 13 assembly. Above the spring retainer plate 15, two pins 16, 17 project from opposite sides of telescopic tube 13 through longitudinal slots 18, 19 into the telescopic tube 13. The depth of penetration of the pins 16, 17 into the telescopic tube 13 is adjustable by means of wing nuts 20 and 21. By appropriate adjustment of either wing nut 20 or 21, the corresponding pin may be extended so as to project into the path of displacement of the lower end of the telescopic rod 13*a*. Conversely, either pin may be retracted by its wing nut so as to not project into the path of the telescopic rod 13*a*. FIG. 4 illustrates both possibilities. Wing nut 20 has been adjusted to allow pin 16 to project into the path of the telescopic rod 13*a* whereas wing nut 21 has been adjusted to retract pin 17 from the path of the telescopic rod 13*a*. Bias springs 62, 63 surrounding the pins 16, 17 serve to bias the pins to project into the path of telescopic rod 13*a*.

Two guide rings 24, 25 surround the telescopic tube 13 and are able to slide along that tube. At the lower end of guide ring 24, a shovel 27 is attached via a horizontal hinge 26. A second shovel 29 is attached via horizontal hinge 28 to the extension 30 of upper guide ring 25. The purpose of the extension 30 is to ensure that the two shovels 27, 29 are positioned at the same height.

Tilting levers, 32, 33, having pins 16, 17 secured to their respective upper ends, are attached to the shovels 27, 29. The upper ends of the tilting levers 32, 33 are guided in the longitudinal guide slots 18, 19 of the telescopic tube 13 by the pins 16, 17.

Figure 1:
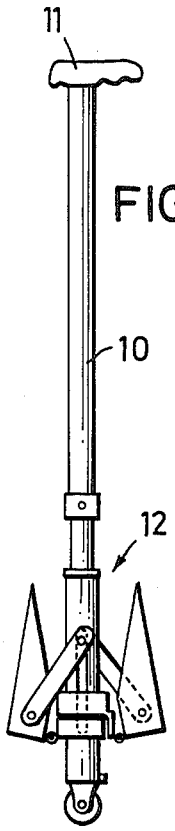
FIG. 1 is a side view of the first embodiment of the invention.
Figure 2:
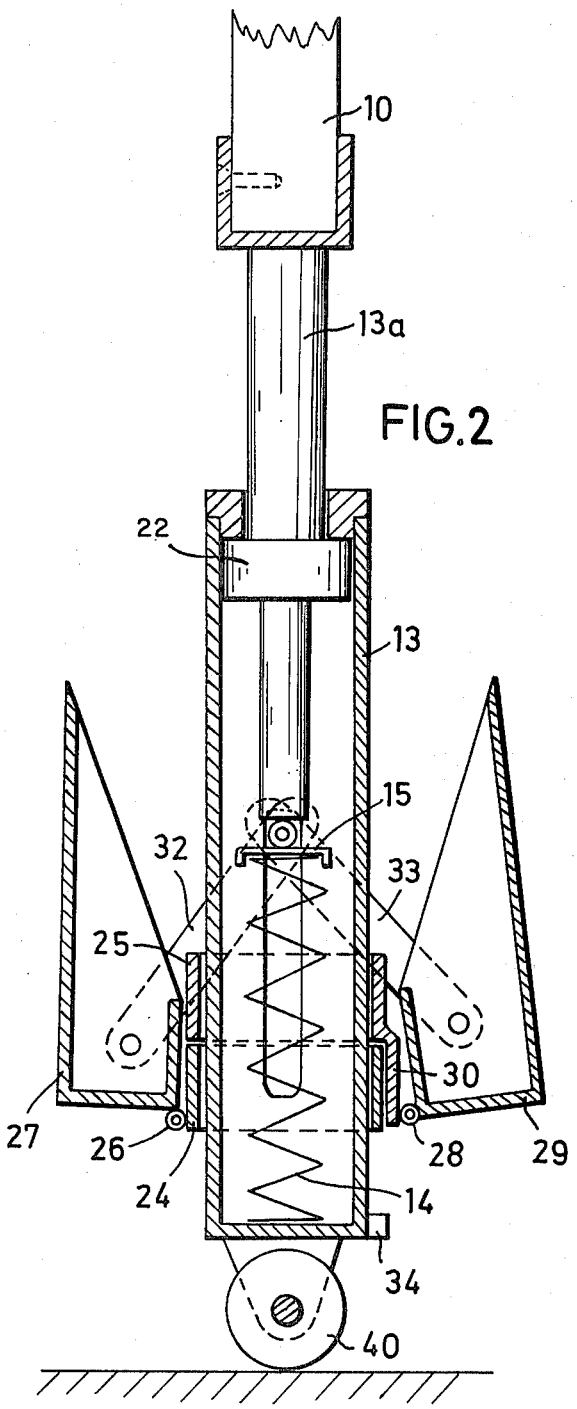
FIG. 2 is a longitudinal section on an enlarged scale through the lower part of the device pictured in FIG. 1.

Spring 14 with plate 15 is located below the end of telescopic rod 13*a* and pins 16, 17. By exerting pressure between the telescopic rod 13*a* and pins 16, 17 on one end and the bottom of the telescopic tube 13 on the other end, the spring 14 tends to hold the telescopic tube 13 against the collar 22, as illustrated in FIGS. 1 and 2. When telescopic tube 13 is so maximally extended with respect to telescopic rod 13*a*, the upper ends of tilting levers 32 and 33 are so positioned as to hold shovels 27, 29 with their bottom surfaces vertical.

Figure 3:
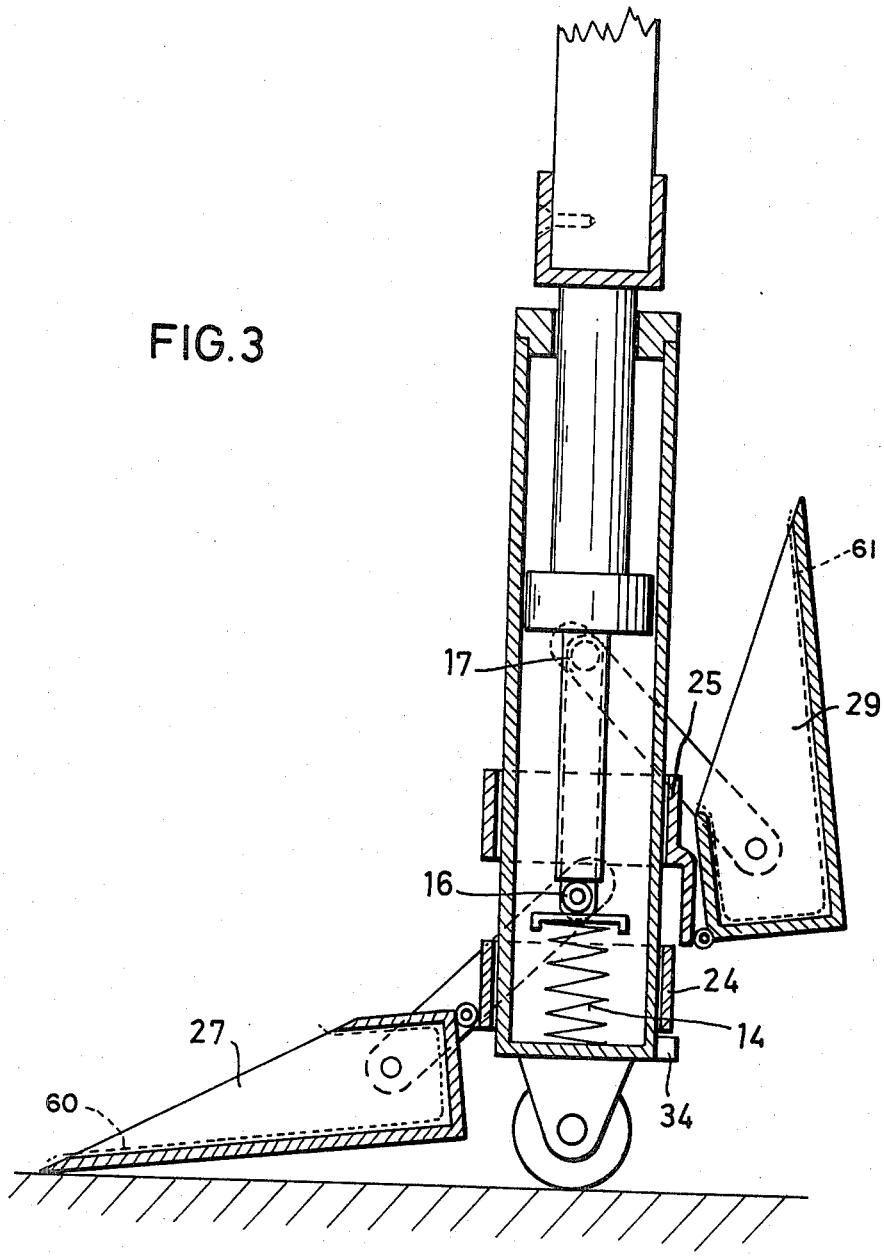
FIG. 3 is a view similar to that of FIG. 2 but illustrating one shovel tilted horizontal and another shovel in its upright position.

When axial pressure is exerted on the shaft 10 from above, the spring 14 is compressed (FIGS. 3 and 4). Depending upon the adjustments of wing nuts 20, 21, either or both of the pins 16, 17 may be lowered in their respective guide slots 18, 19, causing the respective guide rings 24, 25 to be lowered until abutting against a stop 34 provided at the lower end of the telescopic tube 13. An additional downward movement of the telescopic rod 13*a* will cause the shovels 27, 29 to tilt about their respective hinges 26, 28, until positioned flat on the ground. FIGS. 3 and 4 portray the situation where, due to the previously discussed adjustment of wing nut 20, guide ring 24 is lowered until it abuts against stop 34 and shovel 27 is tilted into its horizontal position. By appropriate adjustment of wing nut 21, guide ring 25 and shovel 29 may be similarly lowered and positioned.

Figure 5:
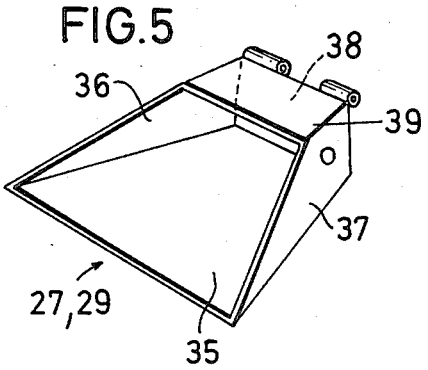
FIG. 5 is a perspective view of a shovel employed in the apparatus of FIGS. 1, 2, 3 and 4.

The shovels are shaped as illustrated in FIG. 5. Their underside 35 is planar, the side walls 36, 37 are inclined, the back wall 38 is rectangular and the upper side 39 is trapezoidal. By this means, the shovels 27, 29 form a box which has an inclined opening. The inside of each shovel contains a removable liner 60, 61. The liner may be of absorbent paper or other such substance as to prevent contamination of the shovel yet be low in cost.

To collect animal excrements dropped on the ground, the stick is telescopically compressed, lowering one or the other shovel into position. A roller or a wheel 40 is provided at the lower end of the telescopic tube 13 to allow for easy pickup of the excrements by a lowered shovel.

Disposal of the excrements is effected by placing the stick into a trash can, toilet bowl or other disposal container. By axial pressure on the stick 10, the shovels 27, 29 are lowered, causing the liners together with their contents to fall off and be disposed of.

FIGS. 3 and 4 illustrate the lowering of only one shovel 27, while shovel 29, perhaps already containing excrements remains in its vertical position. To accomplish this, pin 17 must be retracted by tightening the wing nut 21 on pin 17, pulling the pin outside the path of movement of the telescopic rod 13*a*. When the apparatus is telescopically compressed, the telescopic rod 13*a* does not contact this pin, causing the shovel 29 to maintain its position. If necessary, the tilting lever 33 may be clamped in its guide slot 19 by the wing nut 21, preventing the shovel from dropping due to its weight.

In a second and separate embodiment of the invention, as illustrated in FIGS. 6 to 8, a container 45 is provided whose bottom 46 may be opened or removed. The shape of the container 45 is substantially cylindrical. It has two substantially round apertures 47, 48 on its sides, into which shovels 49, 50 may be inserted. By means of the handles 53, 54 either shovel may be moved out of its opening to collect animal excrements. Thereafter, it may be reinserted into its aperture 47 or 48 and rotated 180° about its handle 53 or 54 as indicated by arrows in FIG. 7. As a result, the bottom of the shovel is turned up and the excrements fall into the container 45 which is provided with an absorbent paper liner 55.

When the container 45 is to be emptied, the bottom 46 is extracted laterally by pulling the handle 56. The paper liner 55 drops, together with the excrements, into the trash can, toilet bowl or other disposal receptacle. A new paper liner 55 is then inserted into container 45 and the bottom 56 is returned to its normal position.

It is not necessary for the bottom to be designed as a removable system, but it may also be opened by tilting or other such mechanism.

The paper liner on the shovel is evident from FIG. 8. The liner 57 is formed to fit the internal shape of the shovels 49, 50. At its front edge 58, it is reinforced or of double layer construction to avoid tearing when scraped across the ground.

I claim:

1. A device for the retrieval and disposal of animal excrement, comprising:

an elongated shaft, an end member relatively slideably engaging the lower end of said shaft, at least one scoop pivotally attached to said end member, linkage means for pivoting said scoop into an excrement retrieving orientation upon relative sliding movement of said shaft and said end member in a first direction and for oppositely pivoting said scoop into an excrement retaining orientation upon relative sliding movement in the opposite direction, and a bias spring, inside said end member, for compressibly biasing said shaft and said end member in said opposite direction, thereby biasing said scoop in said excrement retaining orientation, said scoop being pivoted to said excrement retrieving orientation when a force is exerted on said shaft in said first direction sufficient to overcome the bias of said bias spring and to cause said relative sliding movement of said shaft and said scoop in said first direction.

2. A device for the retrieval and disposal of animal excrement, comprising:

an elongated shaft;

an end member relatively slideably engaging the lower end of said shaft;

at least two scoops, each separately pivotally attached to said end member;

linkage means for pivoting an engaged scoop into an excrement retrieving orientation upon relative sliding movement of said shaft and said end member in a first direction and for oppositely pivoting said scoop into an excrement retaining orientation upon relative sliding movement in the opposite direction; and separate linkage engaging means operatively associated with each scoop for separately, selectively engaging said linkage means with the associated scoop so that said sliding movement of said shaft will cause said linkage means to pivot only the selectively engaged scoop.

3. A device for the retrieval and disposal of animal excrement, comprising:

an elongated shaft;

an end member relatively slideably engaging the lower end of said shaft;

at least one scoop pivotally attached to said end member;

linkage means for pivoting said scoop into an excrement retrieving orientation upon relative sliding movement of said shaft and said end member in a first direction and for oppositely pivoting said scoop into an excrement retaining orientation upon relative sliding movement in the opposite direction; and wherein said end member comprises a tube telescopically receiving said shaft lower end, and a guide ring surrounding said tube, said scoop being pivotally attached to said guide ring.

4. A device according to claim 3 wherein said linkage means comprises:

a guide rod connected at one end to said scoop, and a pin, connected to the other end of said guide rod and extending through a longitudinal slot in said tube, which engages the lower end of said shaft.

5. A device according to claim 4 further comprising:

compression spring means, situated within said tube, for urging sliding movement of said pin and said shaft lower end relative to said tube in said opposite direction which causes pivoting of said scoop to said excrement retaining position.

6. A device according to claim 4 further comprising:

a second guide ring surrounding said tube, a second scoop pivotally attached to said second guide ring, a second guide rod connected at one end to said second scoop, a second pin connected to the other end of said second guide rod and extending through a second longitudinal slot in said tube, said pin and said second pin being individually selectively moveable between positions of engagement and disengagement with said shaft lower end, whereby sliding movement of said shaft in said first direction will pivot only that scoop the pin associated with which is positioned for engagement with said shaft lower end.

7. A device according to claim 6 wherein said pins are separately retractable laterally of said tube to accomplish said disengagement, and wherein a compression spring is mounted within said tube to urge sliding movement of said shaft and said engaged pin relative to said tube in said direction causing pivoting of said scoop to said excrement retaining position.

8. A device according to claim 1 wherein said scoop is provided with an envelope conforming to the interior shape of said scoop, said envelope being removable and disposable with said retained excrement.

9. A device for the retention and disposal of animal excrement, comprising:

at least two separate scoops, each scoop having a removable and disposable lining, each lining conforming to the interior shape of the respective scoop, and common support means for rotatably supporting said scoops, each scoop separately and independently rotatable with respect to said common support means between an excrement retaining orientation associated with said scoop and an excrement disposal orientation associated with said scoop.

10. A device for the retention and disposal of animal excrement, comprising:

at least two separate scoops, each scoop having a removable and disposable lining, each lining conforming to the interior shape of the respective scoop, common support means for rotatably supporting said scoops, each scoop being separately rotatable with respect to said common support means between an excrement retaining orientation and an excrement disposal orientation, said support means including an elongated shaft having a lower end member telescopically attached thereto, said scoops being rotatably supported by said end member, each scoop being separately disengageably connected to said shaft, whereby when engaged, telescopic movement of said shaft and said end member will cause said engaged scoop to rotate between said excrement retaining and disposal orientations.

11. A device according to claim 9 wherein said support means comprises:

an enclosed container having an openable bottom, a disposable, generally bowl-shaped insert situated within said container on the bottom thereof, a pair of openings in the side of said container each receiving one of said scoops with the handle portion of each scoop extending outwardly of said container, each opening and the associated scoop being conformally shaped to permit rotation of said scoop between an orientation in which excrement is retained in said scoop and a disposal orientation in which excrement drops from said scoop into said bowl-shaped insert.

12. A device according to claim 9 wherein each scoop has a handle and forms part of a container having an openable bottom and containing a paper insert, the container having at least one lateral aperture into which the paper lined scoop can be inserted with the handle of the scoop projecting to the outside of said container, a plate of the scoop forming a closure for said container.

13. A device according to claim 12 wherein said scoop can be rotated in the aperture.

14. A device for receiving and removing animal excrement, comprising:

a telescopic shaft, a shovel fitted to said shaft, a liner for said shovel, said liner being removable from said shovel together with the animal excrement therewithin, said shovel being pivotable about a horizontal axis, and when tilted down, lying substantially flat on the ground, and when tilted up, forming at least part of a portable container, and wherein said shaft is telescopically compressible in the longitudinal direction against the action of a spring, said shaft having an end which, upon compression of said shaft, causes the shovel to tilt down.

15. A device according to claim 14 wherein two independent shovels are provided on said shaft, each shovel having a pin which can be optionally engaged with said end.

16. A device according to claim 15 wherein each shovel is fitted to a separate guide ring surrounding said shaft and wherein said pins are mounted to be adjustable to permit selectable engagement of one or the other shovel to said end.

17. A device according to claim 14 further comprising:

linkage means, pivotably connected to said shovel and selectively engagable with said end, for tilting down said shovel when said linkage means is engaged with said end and said shaft is longitudinally compressed.

18. A device for the retrieval of animal excrements, comprising:

an elongated shaft having a lower end;

a tube telescopically slidable with respect to said shaft lower end between an extension position and a compression position;

a bias spring, inside said tube, for biasing said tube into said extension position;

a scoop pivotally coupled to said tube;

linkage means, interconnecting said scoop and said shaft, for pivoting said scoop into an excrement retrieving orientation when said tube is slid to said compression position, and for oppositely pivoting said scoop to an excrement retaining orientation when said tube is biased to said extension position.

* * * * *